US007676972B2

(12) United States Patent
Smith et al.

(10) Patent No.: US 7,676,972 B2
(45) Date of Patent: Mar. 16, 2010

(54) PORTABLE SELF-DEFENSE DEVICE

(76) Inventors: Duane Smith, 1217 Rincon Ave., Livermore, CA (US) 94551; Derrick Evans, 1217 Rincon Ave., Livermore, CA (US) 94551

( * ) Notice: Subject to any disclaimer, the term of this patent is extended or adjusted under 35 U.S.C. 154(b) by 0 days.

(21) Appl. No.: 12/016,435

(22) Filed: Jan. 18, 2008

(65) Prior Publication Data

US 2009/0183413 A1 Jul. 23, 2009

(51) Int. Cl.
*F41B 15/04* (2006.01)
*F41B 9/00* (2006.01)

(52) U.S. Cl. ..... 42/1.08; 89/1.11; 361/232

(58) Field of Classification Search ..... 89/36.01, 89/36.02, 36.03, 36.04, 36.07, 36.08, 36.09, 89/36.12, 36.17, 1.1, 1.11; 428/188, 304.4, 428/313.3, 314.2, 321.5, 457, 1.08; 42/1.08; 102/370; 361/232

See application file for complete search history.

(56) References Cited

U.S. PATENT DOCUMENTS

| | | | | | |
|---|---|---|---|---|---|
| 3,374,708 | A | * | 3/1968 | Wall | 89/1.11 |
| 3,971,292 | A | * | 7/1976 | Paniagua | 89/1.11 |
| 4,034,497 | A | | 7/1977 | Yanda | |
| 4,846,044 | A | * | 7/1989 | Lahr | 89/1.11 |
| 4,852,454 | A | * | 8/1989 | Batchelder | 89/1.11 |
| 4,930,392 | A | * | 6/1990 | Wilson | 89/1.11 |
| 5,103,366 | A | * | 4/1992 | Battochi | 361/232 |
| 5,225,623 | A | | 7/1993 | Krasnow | |
| 5,409,638 | A | * | 4/1995 | Battochi | 252/503 |
| 5,625,525 | A | * | 4/1997 | Coakley et al. | 361/232 |

* cited by examiner

*Primary Examiner*—Bret Hayes

(57) ABSTRACT

A non-lethal self-defense device that ejects two electrically charged streams of conductive fluid at a biological target for a period of time sufficient to have the liquid contacting both the target and the electrically charged device until incapacitation of the target occurs.

20 Claims, 7 Drawing Sheets

PORTABLE SELF-DEFENSE DEVICE

BACKGROUND OF THE INVENTION

A. Field of the Invention

This invention pertains to self-defense devices, and more particularly to a device adapted to stun an assailant by projecting an electrically charged fluid.

B. Prior Art

Various non-lethal self-defense weapons exist in the prior art. For example, hand held devices capable of delivering an electric charge to an assailant are well known. However, such devices require the user to be in close proximity to the assailant for contacting the assailant with a high voltage element on the device. For obvious reasons, this is undesirable. U.S. Pat. No. 4,034,497 to Yanda discloses a self-defense device having a reservoir of liquid which is heated by detonation of a cartridge prior to projection at an assailant. While this device allows the user to maintain a safe distance from the assailant, heated liquid is not perceived as effective a deterrent as an electric shock.

U.S. Pat. No. 5,225,623 to Krasnow discloses a stun gun with one or two reservoirs having a filling port for introducing a fluid and a one-way vent for maintaining air pressure on the liquid as the reservoir level drops. A handle portion includes a battery power supply, a trigger-style on-off switch for accessing the power supply, and a trigger guard. Each of two barrels communicates at its proximal end with a reservoir and at its distal end with a nozzle, the reservoir, barrel and nozzle collectively defining a fluid path. While this devise appears to allow the user to incapacitate the target at a distance, the internal configuration/components of the described device do not allow for consistent or reliable use. Further, this device does not allow for a sufficient duration of charged liquid flow on the target.

Prior attempts to use electrically conductive fluid to deliver a shock to a biological target as a means of rendering it dysfunctional by causing muscle contraction have generally failed because these devices were designed in such a way as to cause only a very short period of flow (squirt) to the target, thus minimizing or eliminating contact with the electrical source and electrical current flow. In order to effectively disable the biological target, the conductive fluid must flow long enough to allow for the liquid to penetrate clothing and sustain an effective shock for a minimum of two seconds. If however, the conductive fluid and in the case of the device described herein, the pressurized gas that is pushing the fluid out, is not metered sufficiently, the fluid flow will end and disconnect the fluid from the conductive nozzles cutting current flow prematurely and consequently be totally ineffective.

The non-lethal defense system that has been accepted by law enforcement agencies across the nation "TASER" delivers an electrical shock via two wires with barbs at the end of them to a human target. After contact is made with the human target, the electric shock produced by the unit via the dart like barbs that are connected to the wires is meant to disable the human target. This approach has variety of disadvantages. First, the system is somewhat unreliable, and not easily reloaded.

Moreover, contact is recommended to be made in the back of the human body of an attacker, which means that you must have some sort of physical contact with the attacker to deliver an accurate shot. If the barbs miss or only one barb hits the human target the device will not work. If the attacker should pull one of the barbs out of his body the device is no longer useful. If any of these disadvantages should occur, the individual using the device will not have an opportunity to discharge a second shot because this device has only one shot and takes several seconds to reload the device. In such eventuality, the device becomes useless and the user must rely on another method of defense.

It is, therefore, an object of the present invention to provide a self-defense device which allows the user to electrically shock an assailant while maintaining a safe distance from the assailant and protecting the user from shock.

It is a further object of the invention to provide a reliable self-defense device which projects an electrically charged fluid at an assailant for stunning the assailant thereby repelling an attack.

A further object of the invention is to provide a self-defense device which employs a high voltage electrical source in combination with an electrically conductive fluid to provide a desired stun effect.

A still further object of the present invention is to provide a stun gun which is convenient to handle and which maximizes the electrical potential transferable to the target.

A still further object of the present invention is to provide a stun gun which appears to be a common flashlight.

Still another object of the invention is to provide a portable device which projects a fluid stream, or dual fluid streams, light emitting in transit to, or upon contact with, a target.

BRIEF SUMMARY OF THE INVENTION

This invention relates generally to devices for use as self-defense- and particular, to non-lethal self-defense devices which are used to disable and or incapacitate an attacker at a specific distance by delivering an electrical charge to an attacker.

It is known that such a device is capable of being effective at a distance. The idea being to attempt to avoid a hand-to-hand confrontation. In the event of a hand-to-hand situation, the self-defense device would operate the same as a stung gun device. This device is also easily re-loadable in case the person needs to use this device upon multiple attackers. None of the prior art arrangements are able to satisfy these desires.

This invention provides a multi-use non-lethal device that can be used to overcome a hostile threat at a distance, or at a hand-to-hand range. This invention can be safely shot at or discharged on any surface of the body (including the face) without fear of causing permanent physical injury.

Another purpose of this invention to provide a less than lethal device which has greater range than other conventional devices and does not resemble a handgun. For instance, an embodiment of this invention resembles a flashlight. Thus, not appearing to be a lethal threat will not trigger a lethal response from the combatant.

Additionally, another purpose is to provide a less than lethal device which can be reloaded quickly after the two shots have been exhausted or if there are multiple attackers.

It is also a desire to provide a less than lethal device which is effective, highly portable, light weight and can be concealed at all times.

Further, it is also an objective of this invention to provide a device that limits a user's ability to shock a target for prolonged periods of time, as this has, with other electrically based devices, been a source of abuse, and serious health risks. The device is intended to incapacitate an attacker only, which can be accomplished quickly.

DETAILED DESCRIPTION OF THE INVENTION

Figure 1:
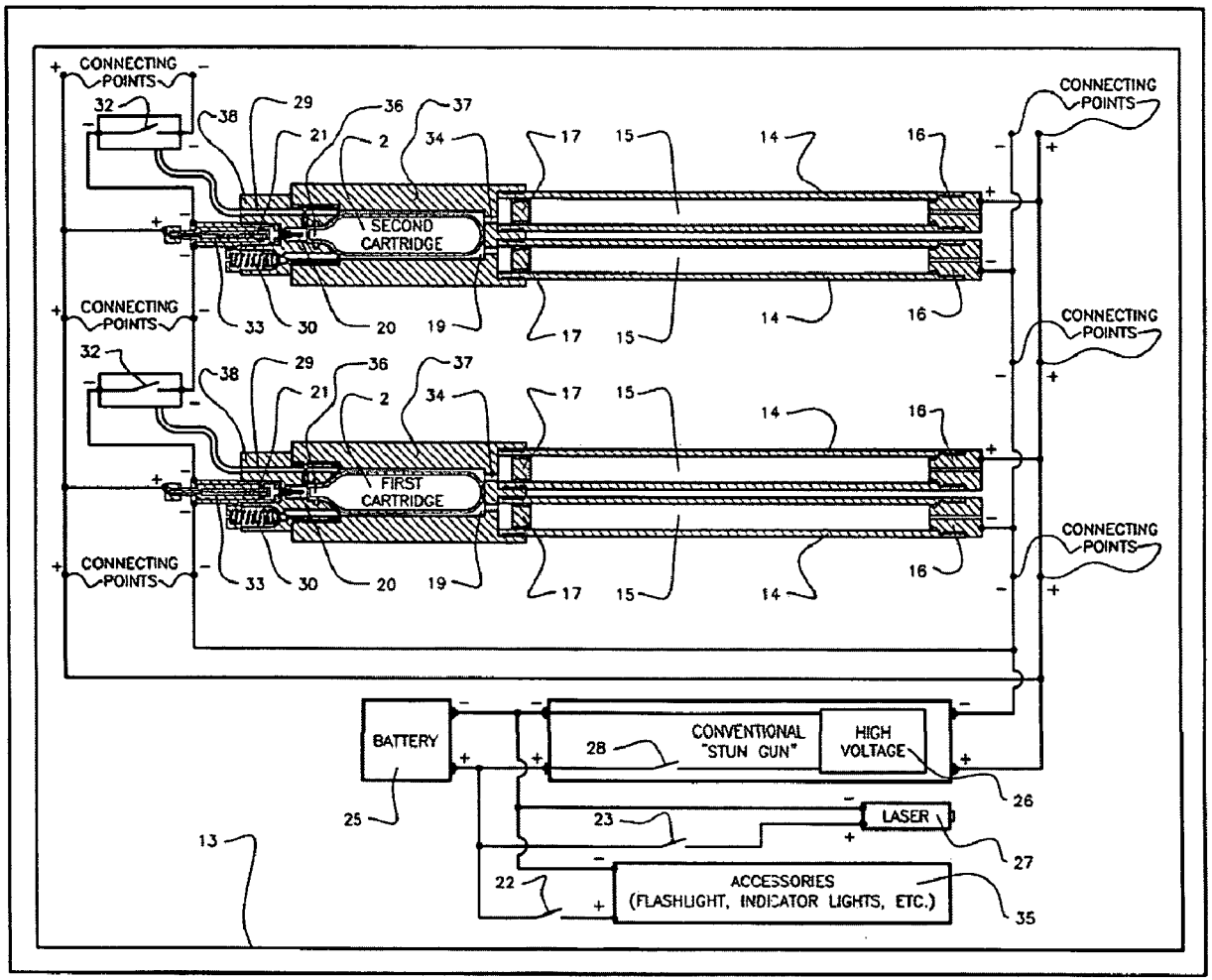
FIG. 1 is a schematic representation of a specific illustrative embodiment of the invention that utilizes a pressurized gas cartridge; along with a chamber that has two tubes containing electrically conductive fluid, and conductive nozzles.
Figure 2:
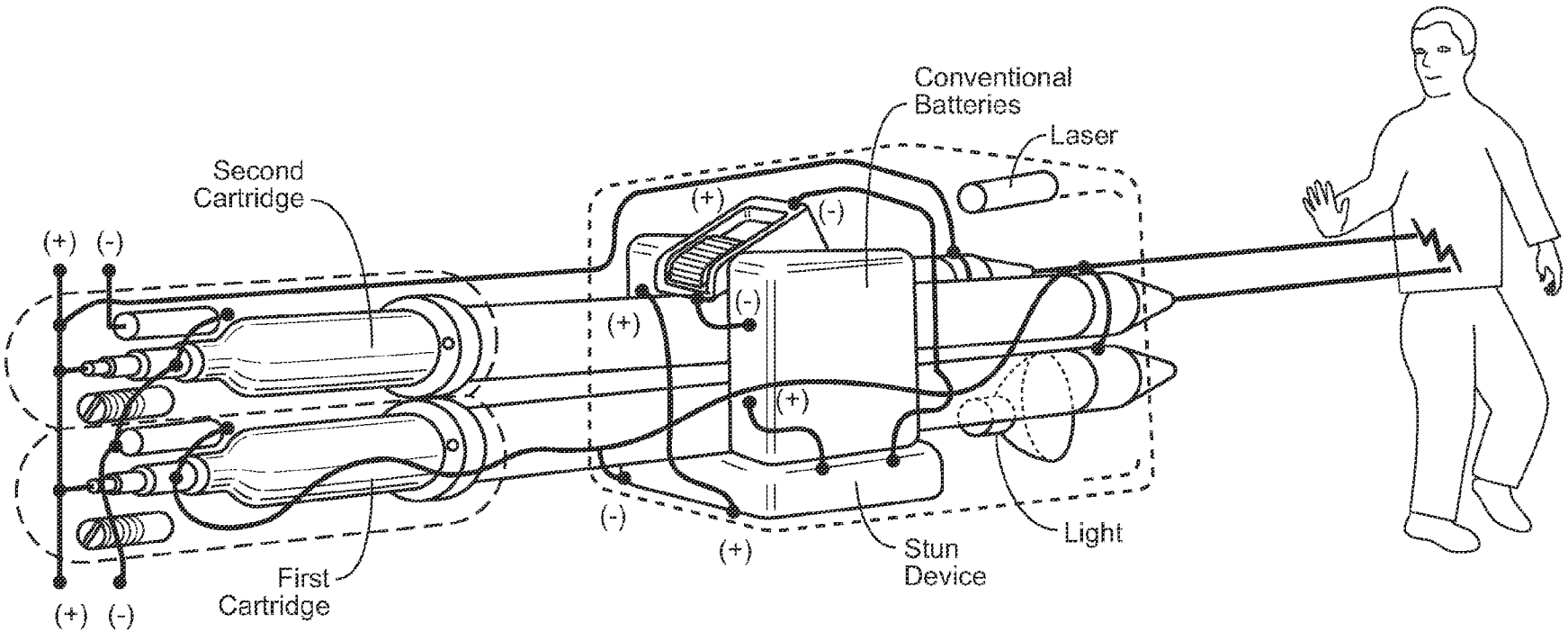
FIG. 2 illustrates accessory devices such as the flashlight & laser mechanisms that can accompany the invention.

The invention herein described provides a non-lethal means to incapacitate a biological target. In accordance with the invention, first and second barrels each comprise two tubular reservoirs for holding electrically conductive fluid. Two pistons are located in the rear of the barrels and fully occupy the interior diameters of the tubular reservoirs. Pressurized gas pushes the pistons simultaneously along the interior of the tubular reservoirs. Both pistons are arranged in sliding and sealing harmony with the interior of a tubular reservoirs. A coupling arrangement encompasses the pistons to each of the expulsion pistons, displacement of the piston(s) in the tubular reservoirs in response to the pressurized gas causes the electrically conductive fluid to be dispersed in the form of a continuous stream from the nozzles of each of the pressurized reservoirs. The desired electrical potential is applied to the continuous stream of electrically conductive fluid being expelled via a conventional stun gun technology system that is attached to the nozzle portion of each tube.

A preferred embodiment comprises two tubular reservoirs for holding the electrically conductive fluid in each chamber or barrel. For example, two tubular reservoirs containing electrically conductive fluid would be located in each barrel. The fluid in the first tubular reservoir will be positively charged, while the fluid in the second tubular reservoir will be negatively charged. It is anticipated that only one of the barrels will be used at a time. This will allow the user to use the device twice without having to reload.

Each barrel includes a pressurized gas cartridge having compressed gas within. An electrically activated lance is provided for piercing the pressurized gas cartridge, whereby the compressed gas is released and directed into the back of the pistons, thus moving the pistons through the tubular reservoirs containing electrically conductive fluid, thereby expelling the fluid. There is also an electrical switch for activating the electrification system, laser sighting device and the flashlight component. The electrical switch is designed to activate the conventional stun gun like component along with the electrically conductive fluid.

The invention includes nozzles which are conductive and also can be used to touch an attacker in a hand to hand situation with the intent to incapacitate. In most situations, there will remain a supply of compressed gas after the electrically conductive fluid is completely expelled. The remaining pressurized gas can be used to create a very loud sound, which can be used to summon assistance.

An embodiment of the invention incorporates a flashlight system to identify the assailant, and a laser is used to assist in aiming the device, particularly in the dark. Additionally, the flashlight system serves to disguise the device as a flashlight, thereby allowing for the element of surprise. The methods used in this non-lethal device for sustaining the length of time that the electrically conductive fluid is making contact with both the device as well as the target is to control the release of the pressurized gas in such a way as to maintain sufficient pressure to adequately push the pistons, and thereby cause substantially straight and solid streams of electrically conductive fluid, for approximately 2-3 seconds before the gas supply is exhausted. The time that the two streams of charged fluid are in contact with the target are referred to herein as "time on target".

When pressurized gas is released from it's container, the rapid expansion of that gas into a chamber with a lower atmospheric pressure will cause rapid cooling where the gas is being released. This cooling can cause ice to form, which can block the flow of the gas and thus disable the mechanism.

The invention described herein reduces this "icing-up" effect by equalizing the pressure difference between the inside of the gas cartridge and the atmosphere surrounding the cartridge. The invention places the gas cartridge in a chamber, which is also the holding container from which the released gas is metered into the piston chambers. When the gas cartridge is breached, the sudden build up of gas pressure causes heat production which helps to counter the cooling caused by gas expansion. Using this method causes an immediate slow down in the gas expansion rate thus minimizing ice production.

Existing electrically charged liquid stream devices have two major limitations, which include the short squirt effect caused by applying pressure to the pistons too quickly, and interruption in the flow of liquid (sputtering) caused by ice blockage (icing-up) at the point of gas emission. The invention described herein effectively eliminates these problems.

A. Embodiments

FIG. 1 illustrates the interior components of a device capable of applying an electrical stun from a distance. This embodiment may comprise a laser sighting device, as well as a recording device, audio, and or visual to capture the event for which the device is being deployed. The invention can also include a range finder device to measure distances to the target as well as the laser sighting device mentioned above. This device can be used as a stun gun for close combat and is preferably re-loadable.

FIG. 1 is a detailed representation of an embodiment of a less than lethal device designed in accordance with the requirements of the proposed invention. The less than lethal device 13 is provided with two or more replaceable tubular reservoirs 14 filled with electrically conductive fluid 15. This embodiment includes chemically resistant electrically conductive nozzles 16. The embodiment shown in this illustration comprises two cartridges 1, wherein each cartridge includes a pressurized gas cartridge 2, two barrels (each barrel containing two tubular reservoirs 14, housing 37, rear housing 38, and nozzles 16. At one end of each tubular reservoir 14 is a sealed piston 17. This piston 17, when subjected to pressurized gas released into the gas chamber 19 on one side, will push the electrically conductive fluid 15 through the tubular reservoirs 14 and through the electrified nozzles 16. As the fluid 15 makes contact with the electrified nozzles 16, the fluid 15 becomes charged. The now electrified fluid 15 traveling through the electrified nozzles 16 is shaped and emitted into two substantially straight and consistent liquid streams which are electrically conductive in such a way as to deliver the high voltage from the "stun-gun" type device 26 to an intended biological target thus rendering the target substantially disabled. The preferred embodiment utilizes voltages in the 500,000 to 950,000 volt range. However, lower voltages may be effective, but may also require greater time of target. Further, higher voltages may also be effective. A sealed pressurized gas cartridge 2, when lanced, supplies the pressurized gas that enters the gas chamber 19. This pressurized gas motivates the piston 17 and pushes the conductive fluid 15 through the tubular reservoirs 14. The pressurized gas cartridge 2 is preferably released by an electrically activated lance 20 that punctures the cartridge 2, which releases the gas into the gas chamber 19 which loosely surrounds the compressed gas cartridge 2. The pressurized gas flows through a channel 34 between gas chamber 19 and tubular reservoirs 14. As pressurized gas pushes the pistons 17 through the tubular reservoirs 14, the fluid 15 flows through the charged nozzles 16 and exits the device in two simultaneous streams.

Each barrel on the device comprises a tubular reservoir 14, a piston, and a conductive nozzle 16. The nozzle 16 on each paired barrel will have different charges (one positive and one negative). For example, the barrel with the 'first cartridge' 2 has a positive nozzle 16 (shown with a "+") and a negative nozzle (shown with a "−"). Therefore, as the fluid 15 is pushed through the positively charged nozzle 16+, the fluid becomes positively charged. And as the fluid 15 is pushed through the negatively charged nozzle 16−, the fluid becomes negatively charged. When the two fluid streams come into contact with each other on the target, the differential voltage from the oppositely charged streams is transferred through the target, causing incapacitation.

Immediately after the electronic firing mechanism 21 for the lance 20 is accelerated forward to puncture the gas container 2, the electronic firing mechanism 21 becomes disconnected, which then allows the full electrical power of the device to be used by the conductive nozzles 16. When the compressed gas is released into the chamber 19, the device maintains consistent and prolonged gas pressure in the chamber 19 and pistons 17 by exhausting some of the gas volume through a pressure regulated blow off valve 30. This allows the device to propel charged fluid in a controlled manner for an extended period of time. The balance of the excess gas in the chamber 19 flows into a pressure activated switch 32 which connects a second pressurized gas cartridge equal to those previously activated. The basic electrical energy supply to the "stun gun" type device 26 and accessories such as laser aiming device 27 flashlights or indicator lights 35 is a battery or batteries 25 equal to that required to energize the "stun gun" type device. The "stun gun" device includes a capacitor. An O ring 36 secures the compressed gas cartridge to the housing 37. The rear housing 38 comprises a blow off valve 30 and an electronic lance 33. When pressure from the gas chamber is exhausted, the air flow tube 29 causes the spring piston 47, the rod 48, and the rod piston to separate. This separation disconnects electrical flow between the battery and the first cartridge (two barrels and the housing).

The electronic lance 33 is a puncturing mechanism that comprises a small explosive device, such as a blast cap, that, when ignited, propels the lance 20 forward and into the compressed gas cartridge 2. Further, after the blast cap is ignited, electricity from the battery 25 is then shunted to the nozzles 16 to charge the fluid 15. The channel 34 allows high pressure gas to flow from the gas chamber 19 to the barrel. The typical compressed gas cartridge 2 will use pressures of 900 to 1200 psi, depending on ambient conditions. Upon discharge of the gas into the gas chamber 19, the pressure will preferably reach 100 to 110 psi. Higher pressures may create shorter time on target, while lower pressure may limit the straight line trajectory of the ejected fluid. The contact point 23 connects the battery 25 to the laser sighting device 27. The contact point 28 connects the battery 25 to the stun gun device. The contact point 22 connects the battery 25 to the flashlight 35.

Figure 3:
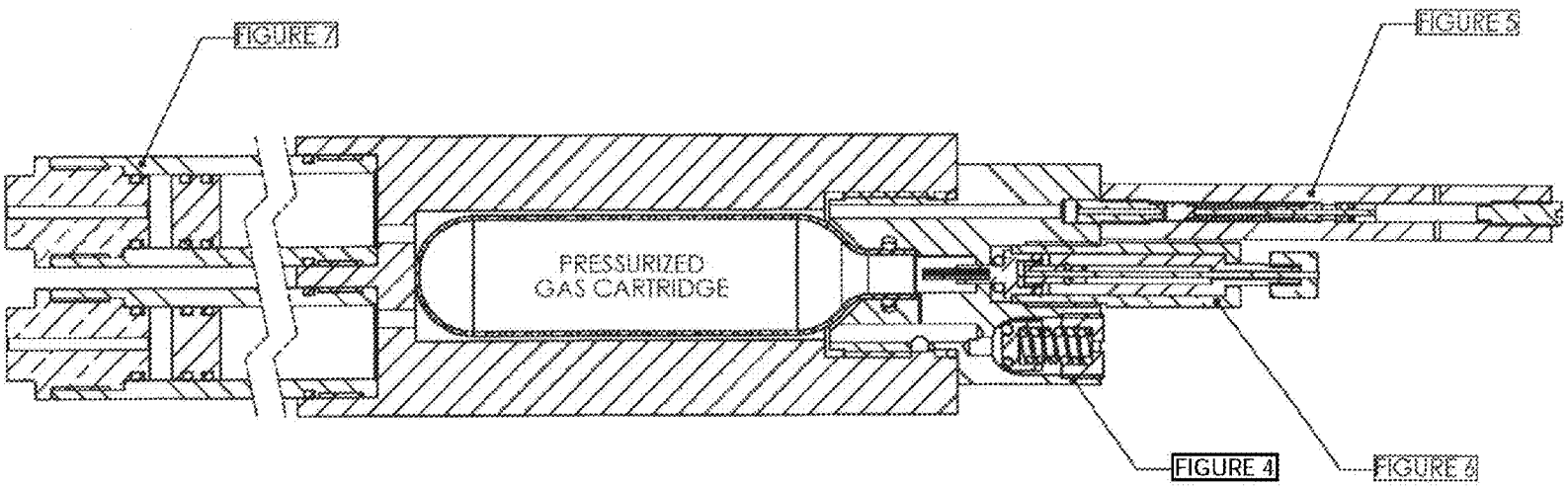
FIG. 3 is an overall sectional representation of a replaceable conductive fluid/gas powered/electrically activated cartridge pack. This view displays the approximate location and relationships of FIGS. 3 through FIG. 7.

FIG. 3 shows an overall sectional representation of a representative cartridge. The cartridge is preferably a replaceable component of the invention. This figure displays the approximate location and relationship of FIGS. 3 through 7.

Figure 4:
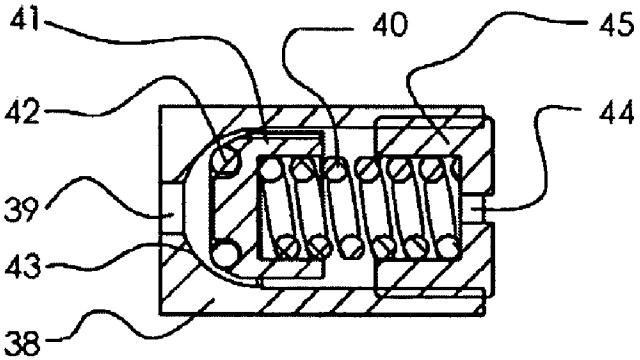
FIG. 4 illustrates how an adjustable mechanism assists in reducing gas pressure released from the pressurized or liquefied gas cartridge

FIG. 4 shows the blow off valve, which is an adjustable mechanism which assists in reducing gas pressure released from the pressurized gas cartridge 2 to a desired level and maintains that level while the charged fluid is being expelled.

When high pressure gas enters through inlet 39 and overcomes adjustable spring 40 tension thus moving the piston's 41 "O" ring 42 away from valve seat 43 thus allowing excess gas pressure to pass through blow-off valve housing 38 and exhaust through housing outlet orifice 44. Spring 40 and piston 41 are held in the housing 38 and against the piston seat 43 by an adjustable screw-in cap 45.

Figure 5:
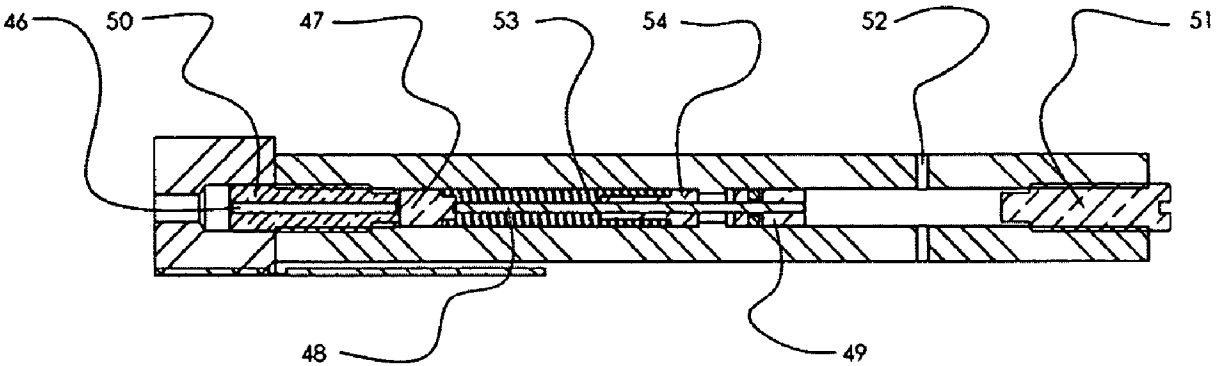
FIG. 5 illustrates a mechanism for transferring the electrical supply from the firing lance mechanism of the first cartridge to a second cartridge.

FIG. 5 is a mechanism for transferring electrical supply from the firing lance mechanism 33 of the first cartridge to second cartridge, after the pressurized gas from the first cartridge is completely exhausted. To activate the electrical switch, pressurized gas from the first cartridge exhaust enters the pressurized gas inlet 46. The gas pressure forces the piston 47 (preferably spring), and rod 48 and rod piston 49 to overcome the spring 53 held in place by the spring stop 54 and move away from the conductor 50 far enough to cause the piston 49 to make contact with conductor 51 and allow gas from the inlet 46 to exhaust through gas vent hole 51. The gap between conductor 50 and spring piston 47 is maintained until gas going into the inlet 46 is completely exhausted, at which time the spring 53 pushes the spring piston 47 back to the original position, and is in contact with conductor 50, thus causing end to end electrical contact from conductor 50 to conductor 51 in a non-conductive housing body. The gas vent holes 52 allow high pressure gas from the switch mechanism into the blow off valve.

Figure 6:
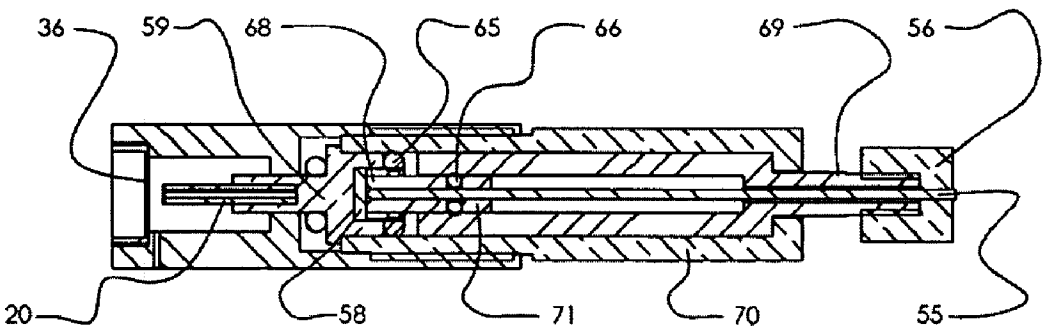
FIG. 6 illustrates a mechanism for puncturing a hole in the sealed neck of a conventional pressurized gas cylinder.

FIG. 6 illustrates a mechanism for puncturing a hole in the sealed neck of a conventional pressurized gas cylinder 2. To activate the mechanism an electrical current is applied at two locations, the conductor rod 55 via the adjacent brass threaded brush 56 and at the opposite end of the switch, the main firing lance 20, firing cap 58, and housing 59 via the main (preferably) brass cylinder 70. When electricity is applied to those locations, it causes an arc to occur at a location between the conductor rod 55 and firing cap 58. The arc causes the contents of the firing cap 58 to rapidly oxidize and expand forcing the main firing pin housing 59 and lance 20 toward the sealed neck end 36 of the pressurized gas cartridge 2. The lance 20 then punctures the seal releasing the pressurized gas. When the o-rings 65 and 66 seal the expanding gas emitting from the activated firing cap 58, thus forcing gas pressure through the conductor rod guide hole 68, thus forcing the piston 71 and attached conductor rod 55 to slide in the housing cylinder 69 in the opposite direction from the lance 20 and cap 58 and cap housing 59. This produces a disconnecting gap between the two electrical fields. When the lance 20 and lance housing 59 thrust toward the pressurized gas cartridge neck and seal 36 it opens a gap between the lance housing 59 and the conductor rod 55 thus disconnecting the electrical supply to the firing cap area and allowing the full electrical power to be applied to the conductive nozzles.

Figure 7:
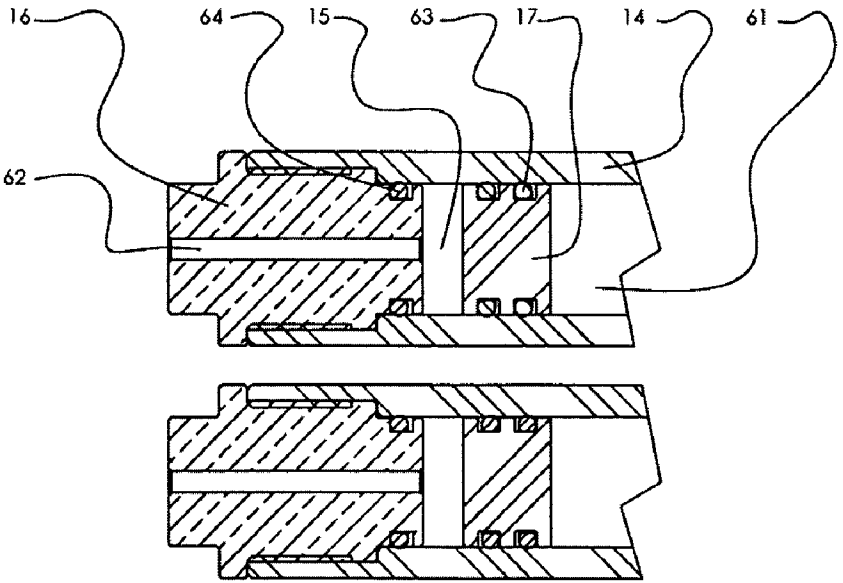
FIG. 7 is a sectional view of a portion of the invention illustrating the tubular reservoirs, and the conductive fluid located between the conductive nozzle and a piston.

FIG. 7 is a foreshortened sectional view before activation that holds a conductive fluid 15 in a tubular reservoir 14 captured between a conductive nozzle 16 with seal 64 at one end of the tubular reservoir 14 (front) and piston 17 with seals 63 located at the opposite end of the tubular reservoir 14.

When the device is activated (gas cartridge 2 punctured) pressurized gas is allowed to enter the channel 34 forcing the piston 17 toward and against the fluid 15 forcing it through the conductive nozzle orifice 62. When this operation is complete, fluid stops flowing, and the nozzles 16 are sealed by the piston's 'O' ring 63 The 'O' ring 63 prevents gas leakage and fluid 15 leakage around the piston 17. Another 'O' ring 64 is located on the back end of the nozzle 16 to prevent fluid leakage past, and around the sides of, the nozzle 16. Excess gas pressure is then forced to exhaust through the adjustable blow off valve 30.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

What is claimed is:

1. A portable device for ejecting continuous streams of electrically charged fluid at a target, the portable device comprising:

an electrically non-conductive housing having a first barrel having a first metallic nozzle defining a first fluid ejection orifice; a first tubular reservoir for a first electrically conductive fluid; a first intake conduit for pressurized gas into the first barrel; and a first piston element located between the first reservoir and the first intake conduit, the piston element being configured to be pushed along the interior of the first barrel by a differential gas pressure; and a second barrel having a second metallic nozzle defining a second fluid ejection orifice; a second reservoir for a second electrically conductive fluid; a second intake conduit for pressurized gas into the second barrel; and a second piston element located between the second reservoir and the second intake conduit, the second piston element being configured to be pushed along the interior of the second barrel by the differential gas pressure;

a compressed gas enclosure;

a liquefied gas cartridge disposed within the compressed gas enclosure;

means for rupturing the liquefied gas cartridge so as to cause high pressure gas to be released therefrom into the compressed gas enclosure and through the first and second conduits against the first and second piston elements; and a high voltage power source having an electrical circuit, a battery power supply and a voltage converter, the voltage converter being in electrically conducting relation with the first and second metallic nozzles so as to impart a first high voltage electrical charge at a first potential to the first fluid exiting the first fluid ejection orifice and a second high voltage electrical charge at a second potential to the second fluid exiting the second ejection orifice.

2. The device of claim 1, wherein the compressed gas enclosure comprises a housing with an adjustable pressure regulated gas exhaust and a gas pressure outlet, the gas pressure outlet being configured to be used for pneumatically activated accessory functions.

3. The device of claim 2, wherein the pneumatically activated accessory functions include a gas pressure on/off switch that activates a secondary pair of barrels.

4. The device of claim 1, wherein the means for rupturing the liquefied gas cartridge comprises an electrically activated lance configured to puncture the liquefied gas cartridge.

5. The device of claim 4, further comprising:

means for disconnecting electric power from the electrically activated lance after the same is activated.

6. The device of claim 1, wherein the liquefied gas comprises carbon dioxide $CO_2$.

7. The device of claim 1, wherein the electrically non-conductive housing is a first electrically non-conductive housing, the device further comprising:

means for transferring electrical power from the first electrically non-conductive housing to a second electrically non-conductive housing.

8. An electrically non-conductive housing, comprising:

a first set of barrels having a first set of metallic nozzles defining a first set of fluid ejection orifices; a first set of reservoirs for a first electrically conductive fluid; a first set of intake conduits for pressurized gas into the first set of barrels; and first piston elements each located between the corresponding first reservoir and the first intake conduit, each first piston element being configured to be pushed along the interior of each of the corresponding first barrel by a first differential gas pressure;

a second set of barrels having a second set of metallic nozzles defining a second set of fluid ejection orifices; a second set of reservoirs for a second electrically conductive fluid; a second set of intake conduits for pressurized gas into the second set of barrels; and second piston elements each located between each of the corresponding second reservoir and the second intake conduit, each second piston element being configured to be pushed along the interior of each of the corresponding second barrel by a second differential gas pressure;

a first gas enclosure in flow communication with the first set of barrels;

a first liquefied gas cartridge disposed within the first gas enclosure;

a second gas enclosure in flow communication with the second set of barrels;

a second liquefied gas cartridge disposed within the second gas enclosure;

means for rupturing each of the liquefied gas cartridges so as to cause high pressure gas to be released into each of the corresponding compressed gas enclosure and through the corresponding first and second sets of intake conduits against the first and second piston elements; and a high voltage power source having an electrical circuit; a battery power supply; and a voltage converter, the voltage converter in electrically conducting relation with said first and second sets of metallic nozzles for imparting a high voltage electrical charge at a first potential to the corresponding electrically conducting fluid exiting one of the first fluid ejection orifices and one of the second fluid ejection orifices and at a second potential to the corresponding electrically conducting fluid exiting the other of the first fluid ejection orifices and the other of the second fluid ejection orifices.

9. A portable device for ejecting continuous streams of electrically charged fluid at a target, the portable device comprising:

a housing having a front portion, a rear portion, and a gas chamber;

a gas cartridge containing a pressurized gas, the gas cartridge having a seal and being disposed in the gas chamber;

a first reservoir having a first end portion thereof connected to the front portion of the housing in flow communication with the gas chamber;

a first metallic nozzle having a first fluid ejection orifice, the first metallic nozzle being disposed on a second end portion of the first reservoir;

a first piston disposed inside the first reservoir between the gas chamber and an electrically conductive fluid disposed inside the first reservoir;

a second reservoir having a first end portion thereof connected to the front portion of the housing in flow communication with the gas chamber;

a second metallic nozzle having a second fluid ejection orifice, the second metallic nozzle being disposed on a second end portion of the second reservoir;

a second piston disposed inside the second reservoir between the gas chamber and an electrically conductive fluid disposed inside the second reservoir;

a puncturing mechanism attached to the rear portion of the housing, the puncturing mechanism having a lance and an explosive device and being configured to move the lance to puncture the seal of the gas cartridge when the explosive device is ignited, the pressurized gas released from the gas cartridge being configured to pressurize the gas chamber and to push the first and second pistons toward the first and second metallic nozzles so as to eject the electrically conductive fluid through the first and second fluid ejection orifices, respectively; and a high voltage power source connected to the first and second metallic nozzles so as to impart a high voltage electrical charge at a first potential to the electrically conductive fluid exiting the first fluid ejection orifice and a second potential to the electrically conductive fluid exiting the second ejection orifice.

10. The device of claim 9, further comprising:

a pressure-regulated blow-off valve mechanism configured to control a gas pressure level in the gas chamber in the housing while the gas cartridge is discharged.

11. The device of claim 10, the pressure-regulated blow-off valve mechanism further comprising:

a rear housing having an inlet and an outlet, the inlet being in flow communication with the gas chamber;

a piston disposed inside the rear housing;

a spring disposed inside of the rear housing, the spring being configured to bias the piston toward the inlet of the rear housing against a valve seat so as to prevent flow through the inlet of the rear housing; and an adjustable cap, wherein, when the high pressure gas from the gas chamber enters through the inlet, the piston is moved away from the valve seat and a portion of the high pressure gas is exhausted through the outlet orifice so as to maintain a consistent and prolonged gas pressure in the gas chamber.

12. The device of claim 9, wherein the first and second reservoirs are replaceable.

13. The device of claim 9, wherein the explosive device is a blast cap.

14. The device of claim 9, the puncturing mechanism, further comprising:

an electronic firing mechanism for the lance, wherein, after ignition, the lance is configured to move toward the gas container and the electronic firing mechanism is configured to disconnect power to the puncturing mechanism so as to allow electric power from the high voltage power source to be supplied to the first and second metallic nozzles.

15. The device of claim 14, the electronic firing mechanism, further comprising:

a cylindrical body;

a housing cylinder connected to the cylindrical body;

a brush disposed on an end portion of the housing cylinder;

a cap housing disposed adjacent to the cylindrical body next to the explosive device, the lance being attached to the cap housing, the cap housing being attached to an inner cylinder; and a conductor rod extending from the brush to the cap housing, wherein, when an electric current is applied to the conductor rod and to an opposite end of the puncturing mechanism, an electric arc is generated to ignite the explosive device to force the cap housing and the lance toward the seal of the gas cartridge to puncture the seal and to force an inner cylinder piston attached to the conductor rod to slide in the housing cylinder in a direction opposite to the direction of motion of the lance to produce a gap in electrical fields so as to disconnect the electric power from the explosive device and connect the electric power to the first and second metallic nozzles.

16. The device of claim 9, further comprising:

a power supply transferring mechanism having, a pressurized gas inlet;

a first conductor disposed adjacent to the pressurized gas inlet;

a piston disposed adjacently to the conductor; and a rod connected to a rod piston and a spring held in place by a spring stop, the rod being configured to move away from the first conductor so as to cause the piston to make contact with a second conductor and to allow gas from the pressurized gas inlet to exhaust through a gas vent hole, wherein a gap between the first conductor and the spring piston is maintained until pressurized gas flowing into the pressurize gas inlet is exhausted, at which time substantially the spring pushes the spring piston back to the original position and is in contact with the first conductor so as to cause an end-to-end electrical contact from the first conductor to the second conductor, wherein the gas vent hole is configured to allow high pressure gas from the switch mechanism into a blow off valve and the power supply transferring mechanism is configured to transfer power from the puncturing mechanism to a puncturing mechanism of another gas cartridge.

17. The device of claim 9, wherein a remaining pressurized gas in the gas cartridge is configured to generate a sound to summon assistance.

18. The device of claim 9, wherein a time on target of the electrically conductive fluid exiting the first and second fluid ejection orifices is approximately 2 to 3 seconds.

19. The device of claim 9, wherein the portable device is shaped as a flashlight.

20. The device of claim 9, wherein a voltage of the high voltage power source varies from about 500,000 to about 900,000 volts.

* * * * *